US006906464B2

(12) United States Patent
Bryant

(10) Patent No.: US 6,906,464 B2
(45) Date of Patent: Jun. 14, 2005

(54) RED INCANDESCENT AUTOMOTIVE LAMP AND METHOD OF MAKING THE SAME

(75) Inventor: Johnny D. Bryant, Cookeville, TN (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 10/144,017

(22) Filed: May 13, 2002

(65) Prior Publication Data

US 2003/0209985 A1 Nov. 13, 2003

(51) Int. Cl.[7] ..... H01J 1/88
(52) U.S. Cl. ..... 313/635; 313/112; 313/311
(58) Field of Search ..... 313/112–113, 635, 313/315, 318, 311, 578, 489, 493, 318.01, 318.03; 445/27; 362/293, 311

(56) References Cited

U.S. PATENT DOCUMENTS

| | | | | | |
|---|---|---|---|---|---|
| 3,365,323 | A | | 1/1968 | Repsher | |
| 3,798,490 | A | * | 3/1974 | Ackerman et al. | 313/311 |
| 4,151,439 | A | * | 4/1979 | Moss | 313/318.01 |
| 4,633,127 | A | | 12/1986 | Beurskens et al. | |
| 4,988,914 | A | | 1/1991 | Rutfield et al. | |
| 6,300,710 | B1 | | 10/2001 | Nakamori et al. | |
| 6,342,762 | B1 | | 1/2002 | Young et al. | |
| 6,411,021 | B1 | * | 6/2002 | Izawa et al. | 313/315 |
| 6,469,443 | B1 | * | 10/2002 | Bryant et al. | 313/636 |
| 6,548,949 | B2 | * | 4/2003 | Ishihara | 313/318.09 |
| 6,570,302 | B1 | * | 5/2003 | Boonekamp et al. | 313/113 |
| 6,580,201 | B2 | * | 6/2003 | Nakamura et al. | 313/112 |
| 6,639,342 | B2 | * | 10/2003 | Boonekamp et al. | 313/112 |
| 2001/0020812 | A1 | | 9/2001 | Sagawa et al. | |
| 2001/0043033 | A1 | | 11/2001 | Ruemmelin et al. | |
| 2001/0043042 | A1 | | 11/2001 | Murazaki et al. | |

* cited by examiner

*Primary Examiner*—Joseph Williams
*Assistant Examiner*—Dalei Dong
(74) *Attorney, Agent, or Firm*—Howard & Howard

(57) ABSTRACT

A red automotive incandescent lamp having a sealed lamp envelope formed from an amber glass, a pair of filaments located within the lamp envelope, and a red pigmented coating applied to an external surface of the envelope. The amber glass provides initial filtering of the shorter wavelengths of visible light, so that the red pigment has to filter out less light and therefore can be made less opaque. As a result, the lamp produces the desired red colored light at a total light output that meets applicable SAE and ECE requirements for automotive lamps.

26 Claims, 1 Drawing Sheet

RED INCANDESCENT AUTOMOTIVE LAMP AND METHOD OF MAKING THE SAME

TECHNICAL FIELD

This invention relates generally to incandescent lamps and, more particularly, to automotive exterior lamp assemblies used to provide turn signal, tail lamp, and braking signal lighting functions.

BACKGROUND OF THE INVENTION

Governmental regulations throughout most of the world require the use of certain colors of light for automotive signaling functions. In particular, red light having specific chromaticity boundaries is typically required for rear tail lamps and brake lamp signaling, and can be used as well for rear turn signals. To achieve this red light, clear incandescent lamps are typically used in a conjunction with a red filter lens. However, the use of a red exterior filter lens can limit the aesthetic styling of the vehicle. Also, in the event the lens is broken open, exposing the lamp, the non-red wavelengths of the emitted light may no longer be filtered out.

Accordingly, various approaches for producing red incandescent lamps have been investigated and proposed over the years. The most common approach is to apply a red pigment to the exterior surface of a standard clear glass lamp. However, while pigments that produce suitable filtering of the light have been known for years, they are not commonly used in automotive applications because the level of pigment concentration required to obtain the proper coloration of the light is so high that the resulting luminance level of the emitted light is too low.

It is therefore an object of this invention to provide an automotive incandescent lamp that provides a red colored light output which meets the applicable governmental requirements for both spectral content and intensity.

SUMMARY OF THE INVENTION

In accordance with one aspect of the invention, there is provided a red incandescent lamp having a sealed lamp envelope formed from an amber glass, a filament located within the lamp envelope, and a coating applied to an external surface of the envelope, wherein the coating contains a red pigment. The amber glass provides initial filtering of the shorter wavelengths of visible light, so that the red pigment has to filter out less light and therefore can be applied in a manner that does not significantly impact the overall opaqueness of the lamp. As a result, the lamp produces the desired red colored light at a higher total light output than conventional red painted or coated bulbs.

In accordance with another aspect of the invention, there is provided an incandescent lamp that emits red light. The lamp includes a sealed vitreous envelope, a filament located within the envelope, and a pigmented coating over at least a portion of the envelope. The envelope is formed from a vitreous material that is at least partially opaque to visible light having a wavelength below 550 nm. The coating is applied to the external surface of the envelope and contains a pigment that is at least partially opaque to visible light having a wavelength below 600 nm.

In accordance with yet another aspect of the invention, a method of manufacturing an automotive lamp is provided using both the glass and pigmented coating compositions described above. The method uses a segment of glass tube having the above-noted composition; that is, an amber glass or other vitreous material that at least partially blocks visible light below 550 nm. First, one end of the glass tube is softened using heat and then blown into a globe using a mold. Then, a filament is inserted into the other end of the glass tube. Finally, a sealed envelope is formed containing the filament, and this is done by softening that other end of the glass tube using heat and sealing that other end by melting of the glass together with the light emitting element contained inside. Thereafter, the pigmented coating is applied.

The coating can include any suitable pigment for producing red light including inorganic pigments such as, for example, iron oxide. The coating can be applied in a thickness of between 0.5 and 1.5 thousandths of an inch, although a thinner or thicker coating can be used as appropriate for a particular application. Similarly, the concentration of the pigment in the coating can be varied up or down with the coating thickness depending upon the density of the pigmentation.

A lamp so constructed can provide a red color that meets both colorimetry and luminance requirements under the applicable SAE and ECE requirements for exterior vehicle lamps. The envelope can be formed into a wedge base lamp to produce GT-8 and other industry-standard lamps.

BRIEF DESCRIPTION OF THE DRAWINGS

A preferred exemplary embodiment of the invention will hereinafter be discussed in conjunction with the appended drawings, wherein like designations denote like elements, and wherein.

DETAILED DESCRIPTION OF THE PREFERRED EMBODIMENT

Figure 1:
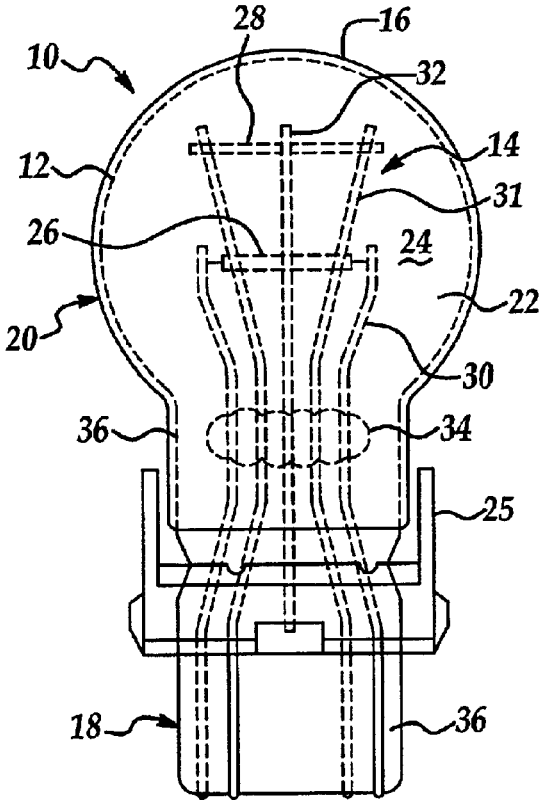
FIG. 1 is a front view of an automotive lamp constructed in accordance with the invention.
Figure 2:
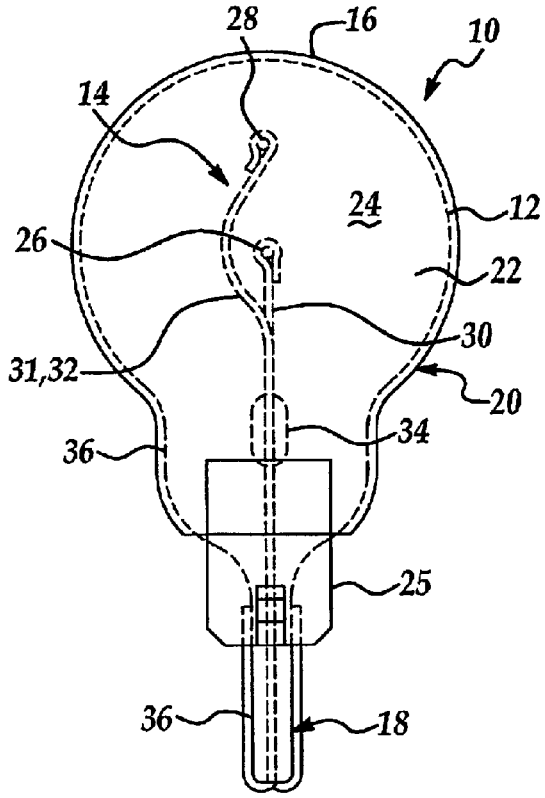
FIG. 2 is a side view of the automotive lamp of FIG. 1.

Referring to FIGS. 1 and 2, there is shown an automotive lamp 10 which in general comprises a sealed glass envelope 12 containing a filament assembly 14 and having an exterior coating 16 of red pigment. As used herein, an "automotive lamp" refers to a lamp that meets one or more automotive regulations or standards for the lamp. Such regulations and standards are well known to those skilled in the art. Envelope 12 is formed from an amber-colored glass and includes a sealed lower portion 18 and an upper portion 20 having a sealed interior region 22 in which there is provided an inert gas fill 24. A sleeve 25 is attached over the press-sealed end 18.

The filament assembly 14 includes a pair of filaments 26, 28, a number of lead-in or support wires 30-32, and a glass bridge 34 that maintains electrical isolation of the lead-in wires while providing additional structural support for the entire filament assembly 14. The two filaments 26, 28 are spaced from each other within the interior region 22 and can be independently operated and used to provide two different levels of lamp illumination, as is known. The lower filament 26 is supported by lead-in wires 30 that extend downward from the filament 26, through the bridge 34, and into the sealed lower portion 18 which is in the form of a wedge base. These lead-in wires 30 extend through the wedge base 18 to an exposed location on the outside surface 36 of the glass envelope 12. In particular, they exit the wedge base at its lowermost edge and run upward along the outer surface 36, terminating at a protected location underneath the outer sleeve 25. This construction provides an exposed portion of the wires for electrical connection of the lamp in circuit, and termination of the lead-in wires 30 underneath the outer sleeve helps prevent the exposed portions of the wires from being inadvertently bent outward away from the wedge base 18. The outer sleeve 25 is a resilient plastic piece that allows the lamp 10 to be securely, but removably, connected to a conventional socket (not shown), with the plastic sleeve cooperating with a conventional socket clip to retain the lamp within the socket in a known manner. A suitable socket design for the lamp 10 is disclosed in U.S. Pat. No. 5,486,991, the entire contents of which are hereby incorporated by reference.

The upper filament 28 is supported by lead-in wires 31 that are curved laterally as shown in FIG. 2 to maintain suitable spacing from filament 26, but that otherwise extend downward through envelope 12 and to an exposed location on outer surface 36 in the same manner as wires 30. Referring back to FIG. 1, the upper filament 28 is also supported by a third support wire 32 which provides mechanical support for the filament at its center. This wire 32 extends downwardly through the bridge 34 and into the wedge base 18, but is terminated there and does not extend to the exterior of the envelope since it is not used to provide operating power to the filament.

The glass composition is selected in conjunction with the pigmented coating to obtain the desired red spectral content of the emitted light at the desired intensity level. This is accomplished by using an amber glass (that is, glass that emits primarily amber light) coated with a layer of red pigment. The amber glass provides initial filtering of the shorter wavelengths of visible light, so that the red pigment has to filter out less light and therefore can be made less opaque. As a result, the lamp produces the desired red colored light at a much higher total light output than can be obtained by simply painting or coating a clear bulb.

The glass envelope can be made from any suitable vitreous material that filters out a substantial amount of the light below about 550 nanometers in wavelength. Such materials include cadmium-impregnated glass as is well known to those skilled in the art. Cadmium-free glass can be used as well, such as a glass having the following composition in the following weight percentages:

| | |
|---|---|
| $SiO_2$ | 72% |
| $K_2O$ | 9.1% |
| SrO | 5.7% |
| $Na_2O$ | 5.5% |
| BaO | 2.2% |
| CaO | 2.1% |
| $Al_2O_3$ | 1.9% |
| MgO | 1.0% |
| $SO_3$ | 0.37% |
| $MoO_3$ | 0.07% |
| $Fe_2O_3$ | 0.03% |
| $P_2O_5$ | 0.02% |
| Cl | 0.01% |
| $TiO_2$ | trace. |

Glass having this specific composition can be obtained from Maeda Glass Co., LTD, of Tokyo, Japan, and it will be appreciated that these weight percentages can be varied within two percent without significantly impacting the amber color filtering effect of the glass.

When used for automotive exterior signal lighting, it should be noted that, although amber colored glass meeting SAE and/or ECE color requirements can be used, other amber or yellow colored glasses not meeting those requirements can be used as well, as long as the combined color filtering of the colored glass and red pigment results in an overall light output that meets the applicable requirements for red color.

The coating 16 can be any suitable composition that includes a pigment capable of filtering out a substantial amount of light below 600 nanometers in wavelength. Inorganic pigments such as iron oxide can be used for this purpose, as is known in the art. The thickness of the pigment coating is selected in conjunction with the concentration (density) of the pigment to obtain the desired color shift and total light output. Preferably, the coating thickness is in the range of 0.5 to 1.5 mils.

For purposes of manufacturing the lamp, the amber glass is initially formed into an elongated tube, with the glass tube then being cut into segments of suitable length for manufacturing individual bulbs. One end of the segment of glass tube is softened using heat and then blown into a globe then cut to length to make an individual bulb. This can be done using a mold with the tube being expanded by air pressure while it is softened to form the enlarged upper portion 20 shown in FIGS. 1 and 2. Then, the filament assembly 14 is inserted into the other end of the glass tube. This filament assembly is pre-manufactured using the bridge 34 to hold the lead-in wires and filaments together as a single unit. Next, a sealed envelope is formed containing the light emitting element, and this is done by softening the then still open end of the glass tube using heat and sealing that open end by melting of the glass together with the light emitting element contained inside. This can be done using a press to seal the glass together and form the wedge-shaped lower portion 18. For purposes of working the glass, it can be softened at about 690° C. with a working temperature of about 1150° C. To remove the air during this sealing operation, the envelope is flushed with krypton while being sealed. Also, a zirconium getter is placed into the interior region 22 before sealing to absorb any residual oxygen.

Using the manufacturing process, the envelope can be formed into a wedge base lamp to produce GT-8 and other industry-standard lamp configurations. Once the lamp has been sealed, the coating 16 is applied using any of a number of different techniques that will be well known to those skilled in the art. Such coating techniques include spraying and dipping. The coating 16 is applied to at least a portion of the exterior surface of the envelope 12, as shown, and can be applied to the entire exterior, if desired. Thereafter, the lead-in wires are bent back over the outer surface of the press-sealed end 18 and the sleeve 25 is then fitted over the end 18.

It will thus be apparent that there has been provided in accordance with the present invention an automotive lamp which achieves the aims and advantages specified herein. It will of course be understood that the foregoing description is of a preferred exemplary embodiment of the invention and that the invention is not limited to the specific embodiment shown. Various changes and modifications will become apparent to those skilled in the art. For example, the lamp can be manufactured using only a single filament. All such variations and modifications are intended to come within the scope of the appended claims.

I claim:

1. A red incandescent lamp, comprising:

a sealed lamp envelope comprising an amber glass;

a light-emitting element located within said lamp envelope; and a red coating covering at least a portion of an external surface of said envelope.

2. An incandescent lamp as defined in claim 1, wherein said red coating comprises a red inorganic pigment.

3. An incandescent lamp as defined in claim 2, wherein said inorganic pigment includes iron oxide.

4. An incandescent lamp as defined in claim 1, wherein said coating has a thickness in the range of 0.5 to 1.5 thousands of an inch.

5. An incandescent lamp as defined in claim 1, wherein said light emitting element comprises a tungsten filament mounted within said envelope.

6. An incandescent lamp as defined in claim 5, further comprising a second tungsten filament mounted within said envelope, wherein said filaments are spaced from each other within said envelope.

7. An incandescent lamp as defined in claim 5, wherein said lamp includes a wedge base comprising a sealed lower portion of said envelope.

8. An incandescent lamp as defined in claim 7, wherein said lamp includes a pair of lead-in wires that support said filament within said envelope and that extend through said wedge base from an exposed location on an outside surface of said envelope to an interior region of said envelope.

9. An incandescent lamp as defined in claim 7, wherein said wedge base further comprises a plastic sleeve attached to said sealed lower portion of said envelope.

10. An incandescent lamp that emits red light, comprising:

a sealed envelope formed from a vitreous material that is at least partially opaque to visible light having a wavelength below 550 nm;

a light-emitting element located within said sealed envelope; and a coating applied to at least a portion of an external surface of said envelope, said coating being at least partially opaque to visible light at wavelengths up to about 600 nm.

11. An incandescent lamp as defined in claim 10, wherein said coating comprises a red inorganic pigment.

12. An incandescent lamp as defined in claim 11, wherein said inorganic pigment includes iron oxide.

13. An incandescent lamp as defined in claim 10, wherein said coating has a thickness in the range of 0.5 to 1.5 thousands of an inch.

14. An incandescent lamp as defined in claim 10, wherein said light emitting element comprises a tungsten filament mounted within said envelope.

15. An incandescent lamp as defined in claim 14, further comprising a second tungsten filament mounted within said envelope, wherein said filaments are spaced from each other within said envelope.

16. An incandescent lamp as defined in claim 14, wherein said lamp includes a wedge base comprising a sealed lower portion of said envelope.

17. An incandescent lamp as defined in claim 16, wherein said lamp includes a pair of lead-in wires that support said filament within said envelope and that extend through said wedge base from an exposed location on an outside surface of said envelope to an interior region of said envelope.

18. An incandescent lamp as defined in claim 16, wherein said wedge base further comprises a plastic sleeve attached to said sealed lower portion of said envelope.

19. An incandescent lamp, comprising:

a sealed glass envelope capable of filtering light at wavelengths below 550 nm;

at least one filament within said envelope, wherein said filament is capable of emitting incandescent light at a number of wavelengths including wavelengths both above and below 550 nm, and wherein at least a portion of the light at wavelengths below 550 nm is filtered out such that visible light exiting said envelope primarily contains light at wavelengths above 550 nm; and a red coating surrounding at least a portion of said envelope, wherein said red coating filters the light exiting said envelope such that the visible light exiting said coating is primarily red in color.

20. An incandescent lamp as defined in claim 19, wherein said glass envelope comprises an amber glass.

21. An incandescent lamp as defined in claim 19, wherein said coating contains a red pigment.

22. An incandescent lamp as defined in claim 19, wherein said coating has a thickness in the range of 0.5 to 1.5 thousands of an inch.

23. An incandescent lamp, comprising:

a sealed glass envelope comprising an amber glass;

a tight-emitting element located within said envelope, wherein said light-emitting element is capable of emitting incandescent light; and a coating surrounding at least a portion of said envelope, wherein light originating from said light-emitting element and entering said coating is filtered prior to entering said coating such that the visible light entering said coating is substantially amber or yellow in color, and wherein said coating further filters the visible light entering said coating such that the visible light exiting said coating is primarily red in color.

24. An incandescent lamp as defined in claim 23, wherein said coating is disposed on an external surface pf said glass envelope.

25. An incandescent lamp as defined in claim 23, wherein said glass envelope filters out a substantial amount of the visible light that is at wavelengths less than 550 nm, and said coating filters out a substantial amount of the visible light entering said coating that is at wavelengths less than 600 nm.

26. An incandescent lamp as defined in claim 23, wherein said incandescent lamp comprises an automotive lamp with said light-emitting element comprising a first filament and said automotive lamp further comprising a second filament located within said envelope.

* * * * *

UNITED STATES PATENT AND TRADEMARK OFFICE

CERTIFICATE OF CORRECTION

PATENT NO. : 6,906,464 B2
DATED : June 14, 2005
INVENTOR(S) : Johnny D. Bryant

It is certified that error appears in the above-identified patent and that said Letters Patent is hereby corrected as shown below:

Column 6,
Line 30, replace “tight-emitting” with -- light-emitting --.

Signed and Sealed this

Twentieth Day of September, 2005

JON W. DUDAS
*Director of the United States Patent and Trademark Office*